US006186878B1

(12) United States Patent
Takizawa et al.

(10) Patent No.: US 6,186,878 B1
(45) Date of Patent: Feb. 13, 2001

(54) APPARATUS RELATING TO SANDERS

(75) Inventors: Toshiaki Takizawa; Mitsuru Akeno, both of Toyama-ken (JP); Masahiko Seki, London; George Kenneth Herdman, Cheshire, both of (GB)

(73) Assignee: YKK Corporation, Tokyo (JP)

( * ) Notice: Under 35 U.S.C. 154(b), the term of this patent shall be extended for 0 days.

(21) Appl. No.: 09/204,151

(22) Filed: Dec. 3, 1998

(30) Foreign Application Priority Data

Dec. 3, 1997 (GB) ..... 9725664
Nov. 4, 1998 (JP) ..... 10-313317

(51) Int. Cl.[7] ..... B24B 23/00
(52) U.S. Cl. ..... 451/357; 451/356; 451/364; 451/490; 451/522; 451/344
(58) Field of Search ..... 451/356, 357, 451/364, 490, 522, 344

(56) References Cited

U.S. PATENT DOCUMENTS 5,709,595 * 1/1998 Bergner et al. ..... 451/356
5,759,094 * 6/1998 Bosten et al. ..... 451/356
5,839,949 * 11/1998 Martin et al. ..... 451/356

FOREIGN PATENT DOCUMENTS 0 726 121 8/1996 (EP) .
0 767 031 4/1997 (EP) .
0 767 032 4/1997 (EP) .

* cited by examiner

*Primary Examiner*—David A. Scherbel
*Assistant Examiner*—Shantese McDonald
(74) *Attorney, Agent, or Firm*—Finnegan, Henderson, Farabow, Garrett & Dunner, L.L.P.

(57) ABSTRACT

A fixing member is provided for fixing a front end section to the rest of a base plate. The fixing member is provided with a surface fastener which is integrally molded with the fixing member.

30 Claims, 11 Drawing Sheets

APPARATUS RELATING TO SANDERS

BACKGROUND OF THE INVENTION

1. Field of the Invention

The present invention relates to improvements in sanding apparatus. In particular, the present invention relates to a fixing member for fixing two sections of a base plate of a hand held sander together and a base plate incorporating such a fixing member.

2. Description of the Related Art

At present, there are many types of hand held sander available for tackling different types of job. In such equipment, sandpaper, glass paper etc. is attached to a base plate and the base plate is connected either to a handle so that it can be manually driven or it can be connected to a motor.

One type of base plate for a hand held, motor driven, reciprocating sander is made up of two layers, a top rigid layer which can be fixed to the motor etc. and a bottom compressible layer which has on its lower surface a surface fastening material so that suitable sandpaper can be easily attached to it.

One particularly adaptable type of sander has a base plate with a shape similar to that of a household iron. The main part of the plate is substantially oblong and tapers to a toe at its front end. A drawback of this type of plate is that the toe of the base plate gets very hot and thus, the toe section of the base plate wears out before the rest of the plate.

Previously, in order to overcome this problem, the lower layer has been supplied in two sections, a back lower section which is substantially permanently fixed to the rest of the base plate and a lower front toe section which is replaceable.

The lower front toe section is made out of a dense foam and is attached to the base plate via a rigid fixing member. The fixing member is in the form of a diamond shaped plate and is attached to the base plate by a screw. The hook part of a hook and loop fastener is glued to the fixing member, and the lower front toe section has a complementary fastener portion on one surface for fixing it to the fixing member, and a fastener portion on the other surface for attachment of the sanding sheet.

This type of arrangement has its disadvantages. Many stages are involved in the fabrication of the fixing member, specifically, a rigid plate is molded, hook type material is cut to the required shape and then the hook type material is glued onto the rigid plate. As the fixing member is fairly small, this can be an awkward and relatively time consuming operation.

Secondly, in operation, as has been stated above, the point of the sander base plate gets very hot. This continual heat recycling of the adhesive can result in the strength of the base plate being seriously degraded and may cause the fixing member to fall apart. In addition, the dust generated during sanding can lodge in the adhesive when it softens due to the heat. Thus providing another mechanism by which the sander base plate can degrade.

SUMMARY OF THE INVENTION

The present invention overcomes the above problems in that the fixing member of the present invention has surface fastener means integral with the fixing member. Therefore, in a first aspect, the present invention provides a fixing member for joining a first section which forms part of a lower surface of a base plate of a sander to a second section of a base plate of a sander, the fixing member being rigid and substantially planar and being provided with surface fastener means on a surface to attach the first section to said fixing member, the surface fastener means being integral with the fixing member.

In some such types of sander, if a section of the base plate is experiencing considerable wear, the fixing member may also need to be replaced. Therefore, it is preferable if the fixing member is removably attached to the second section of the base plate of the sander.

At the time of sanding operation, a part of the first section which forms part of the lower surface of the base plate of the sander becomes very hot locally comparing to the remaining part, thus the surface fastener means disposed at a portion corresponding to the fixing member which fixes the first section to the part of the lower surface of the base plate is liable to be influenced. This may cause the sander to be useless.

Especially, in case that the fixing member is made of a thermoplastic synthetic resin material having a surface shape same as that of the part of the lower surface of the base plate, it is preferable to provide a section without surface fastener so as to have a gap between the lower surface of the base plate and the section without surface fastener, through which heat radiates, thus the part does not get hot.

However, if the section without surface fastener is made to be a mere flat surface where no surface fastener means is formed, there should be a step between the section without surface fastener and the remaining part, which may lead to uneven sanding. Therefore, it is preferable that there provided a projection shorter than the surface fastener means at the section without surface fastener of the surface fastener means of the fixing member. With such projection, the step does not exist and at the same time there still is the gap between the lower surface of the base plate and the section without surface fastener, effective heat radiation can be realized so as to prevent the part to be hot.

The above discussion has been mainly concerned with base plates which have a pointed front toe. Of course, the present invention is of use with any sander base plate where a localised heat source might degrade only a part of the base plate. However, the present invention is of particular relevance to the above described base plate. Therefore, it is preferable if the fixing member joins the first section to the second section such that the first section forms at least part of a pointed front toe of the base plate.

It has been mentioned above that a particularly useful design of base plate has two layers, a rigid upper layer and a compressible lower layer. Sandpaper can be attached to the whole of the lower surface of the lower layer. During many jobs, it is necessary to fit the sander into a narrow space or to sand right up to a corner. Therefore, it is preferable if the upper layer does not extend further than the lower layer a direction parallel to the lower surface of the base plate. Also, to provide rigidity, it is more preferable if the upper layer extends as far as the lower layer in any direction parallel to the lower surface of the base plate.

When both the first and second sections are joined, it is preferable if the sides of the fixing member do not extend over the sides of the lower layer. It is more preferable if the fixing member is provided substantially flush with the side edges of the base plate.

In the situation where the first section forms part of a pointed front toe of the base plate, it is preferable of the fixing member has a point such that it can be attached to the front of the base plate. More preferably the fixing member is attached so that it is flush with the sidewalls of the base plate.

The fixing member will wear over time and due to the heat involved it is more likely to wear at the front toe first. Therefore, it is highly preferable if the fixing member can be inserted in more than one way. For example, the fixing member could have two corners and shaped so the either of the corners could be located at the front point. This prolongs the life of the fixing member. Therefore, it is preferable if the fixing member comprises two or more corners.

It has been found that a particularly preferable design is a diamond shape where either of the two acute corners can be attached flush with the front point of the toe of the base plate.

The toes of the two acute corners of the fixing member are the parts which get hot most. Therefore, the toes may be made to be flat surfaces having no surface fastener means. Alternatively, there may be provided the projection shorter than the surface fastener means in the section without surface fastener.

The fixing member has a surface fastener molded into it. It is more preferable, if the surface fastening means comprises a plurality of molded hooks which project away from the plane of the fixing member. The plurality of hooks being able to engage a plurality of loops provided on the first section.

The fixing member is removably attached to the base plate. It is preferable if the means to removably attach the fixing member attach the fixing member such that an upper surface of the fixing member is adjacent a surface of the base plate, the upper surface of the fixing member being located on the opposing side of the fixing member to the surface fastening means. This can be achieved if the fixing member is provided with a threaded hole such that the fixing member can be screwed to the base plate.

Alternatively, the fixing member could comprise a clip, so that it can be clipped on and off the base plate. It is preferable if such a clip comprises at least two spaced apart elongate members which project out of the plane of the fixing member on the opposing side of the member to the surface fastening means. The elongate members are provided with lugs to engage a complementary member provided on a fixed section of the base plate of the sander.

In a second aspect, the present invention provides a base plate for a sander, the base plate having a lower surface which comprises means for attaching sandpaper thereto, the base plate comprising a removable lower section which forms part of the lower surface, the lower section being attached to the base plate by a planar fixing member, the fixing member comprising surface fastening means for attaching the lower section to the fixing member and the surface fastening means are integrally molded in the fixing member.

As above, it is preferable if the base plate has a pointed front toe and the removable lower section is a section at the toe of the base plate. It is more preferable if the fixing member is removable. The fixing member may be fixed to the base plate by means of a screw. However, preferably, the fixing member is attached to the base plate by means of a clip e.g. a clip as previously described.

It has been mentioned above, that the point of the toe of the base plate experiences a lot of heat. Therefore, fastening means at the point of the toe can melt and seep out of the sides of the base plate. To avoid this problem, it is preferable if the surface fastening means of the fixing member do not extend as far as the point of the base plate.

It is preferable if the base plate according to a second aspect of the present invention comprises a lower layer which forms a part of the lower surface of the base plate and an upper layer fixed to the lower layer, the upper layer extending beyond a side of the lower layer to provide a surface for attachment of said fixing member thereto.

It is more preferable if the fixing member has upper and lower surfaces which are separated by sidewalls, wherein at least a part of a sidewall of the fixing member forms a part of a sidewall of the base plate.

In some situations it may be preferable if the fixing member is integral with the second section of the base plate. Therefore, in a third aspect, the present invention provides a base plate for a sander, the base plate comprising a removable front section which forms a part of a lower surface of the base plate, wherein the removable front section is attached to the remainder of the base plate via surface fastener means, the surface fastener means being provided to fasten an upper surface of the removable front section to a surface on the remainder of the base plate, the surface fastener on the remainder of the base plate being integral with the base plate.

BRIEF DESCRIPTION OF THE DRAWINGS

The present invention will now be described with reference to the specific embodiment in which.

PREFERRED EMBODIMENTS OF THE INVENTION

Figure 1:
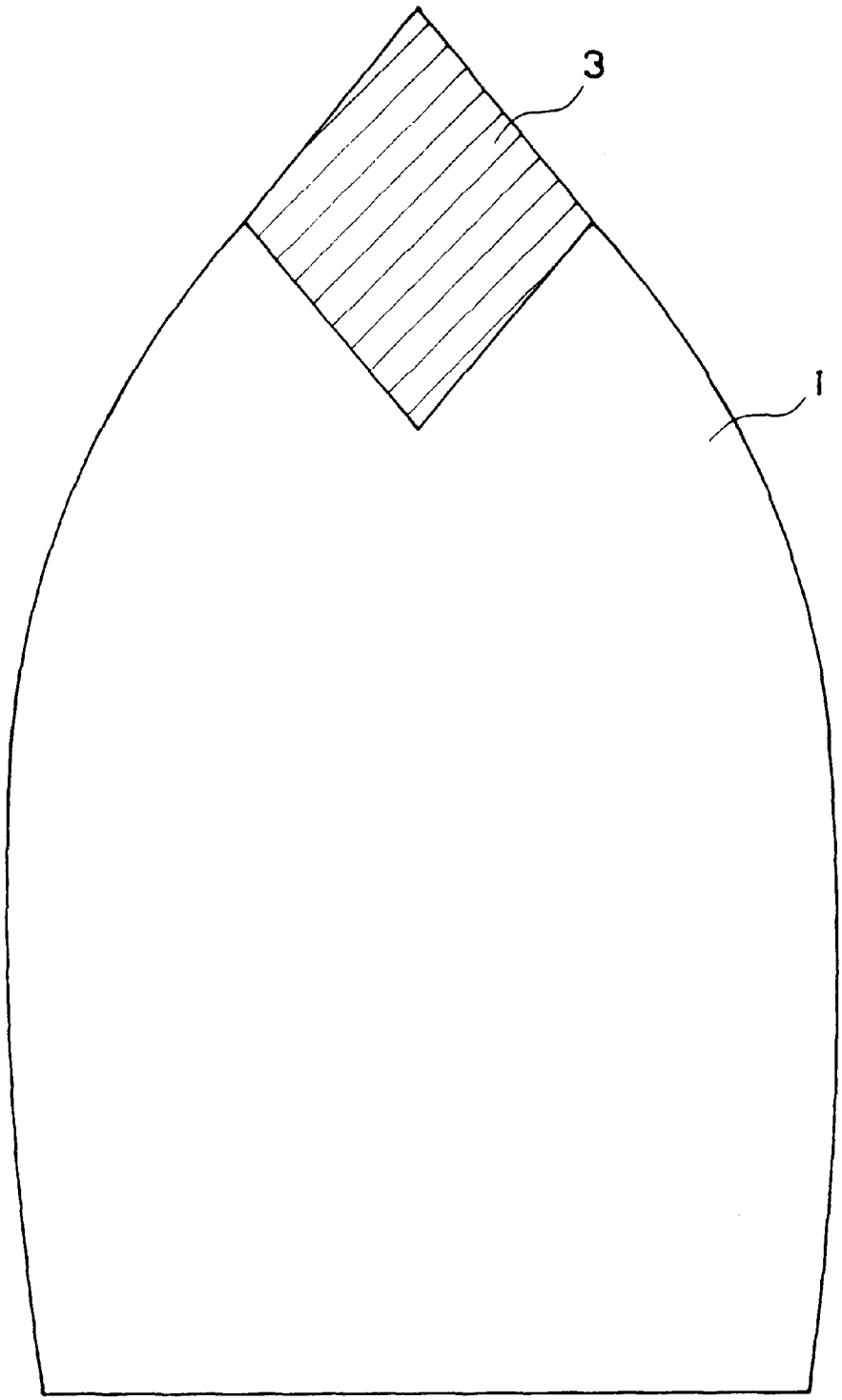
FIG. 1 shows a lower surface of a base plate of a sander.

FIG. 1 shows a lower surface of a base plate of a sander with a removable front section. The base plate 1 is shown with the front section removed. The front section fits in space 3. The rest of the lower surface of the base plate 1 is covered with a hook type material such that a suitably treated sandpaper can be affixed to it.

Figure 2:
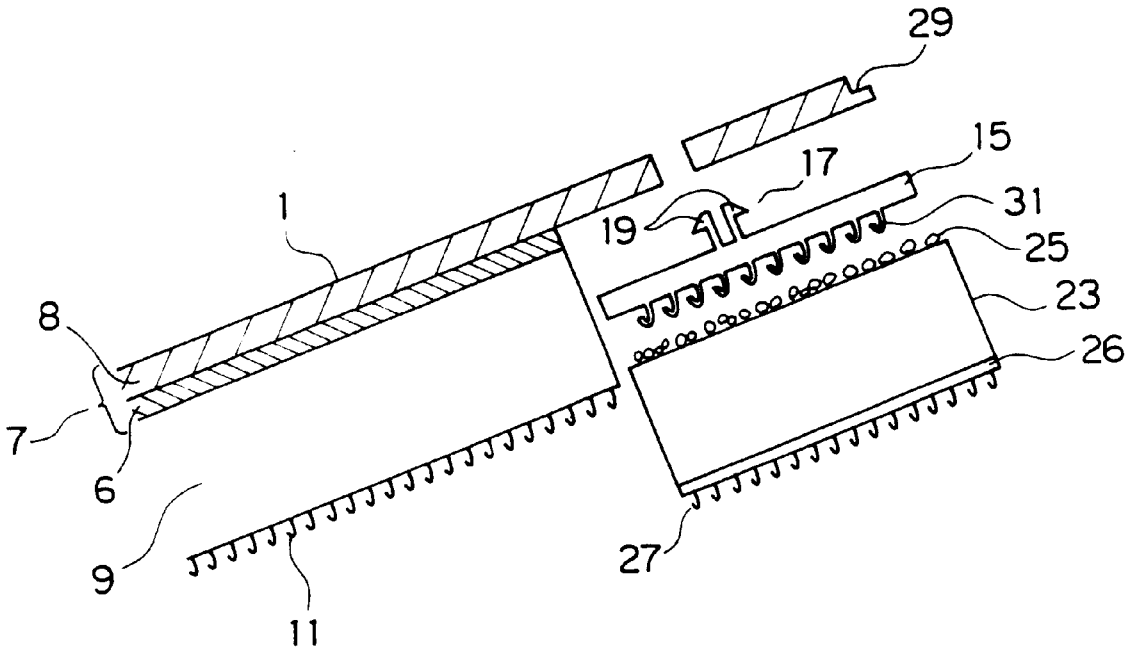
FIG. 2 shows a base plate of a sander in accordance with a second aspect of the present invention.

FIG. 2 shows a side view of the base plate 1. The main body portion of the base plate is made up from two layers.

A rigid upper layer 7 which will be fixed to a motor and a lower layer 9. The lower surface 11 of the lower layer 9 is provided with hook type material so that sandpaper can be attached to it. The upper layer 7 has two sections 6 and 8 which are formed integral with one another. Section 8 extends beyond the end of the lower layer 9.

Figure 4:
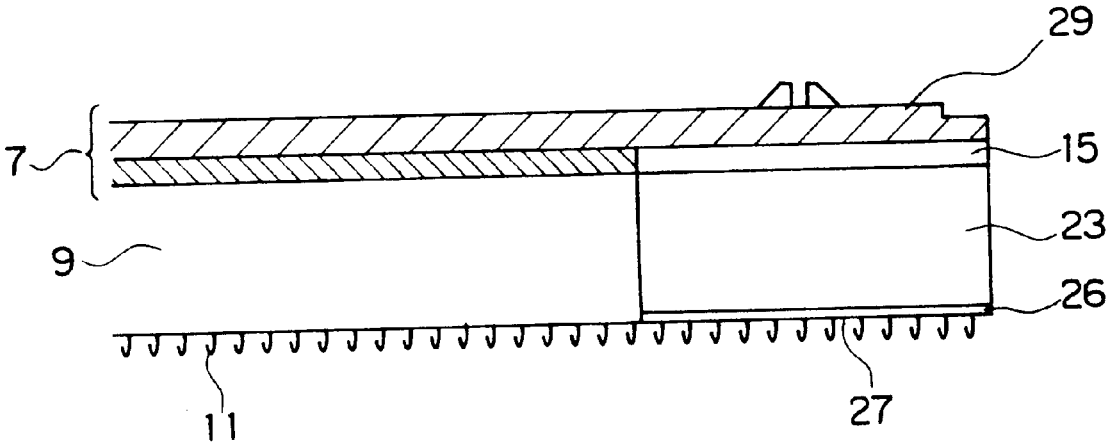
FIG. 4 shows the base plate of FIG. 2 assembled.

A fixing member 15 is fixed via clip 17 to the upper layer 7 as shown in FIG. 4. The clip 17 comprises two elongate members 19 which are provided with lugs. The two elongate members 19 can be squeezed together to release member 15 from the upper layer 7. The lower surface 21 of member 15 is provided with hooks which are integral with member 15. It can be seen that the hooks do not extend right up to the point of member 15. The reason for this is that the point of the base plate still gets very hot and the hooks at this end may melt. The melted hook material can seep out of the sides of the base plate degrading the performance of the base plate.

Once member 15 is attached to upper layer 7, a lower front section 23 is attached to the fixing member 15 via loops 25 on the upper surface of the lower front section 23 engaging with the hooks of member 15. The lower front section 23 is provided with a hook layer 26 which is glued in place. Therefor, the lower front section 23 has a series of hooks on its lower surface for attaching sandpaper to the lower surface 27.

FIG. 4 shows the base plate with the lower front section in place at the toe 29. It can be seen that lower surfaces 11 and 27 align to be flush with each other to form a continuous surface.

Figure 3:
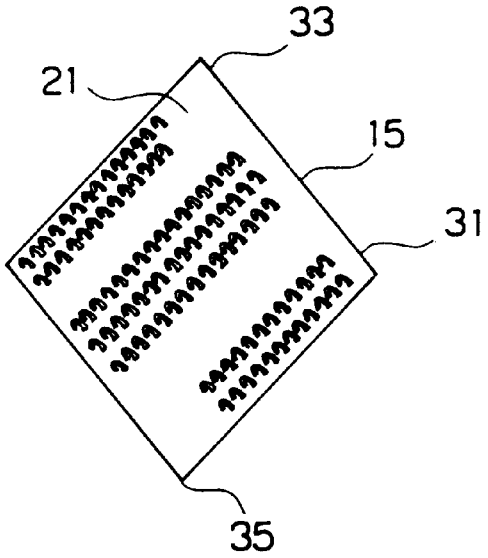
FIG. 3 shows a fixing member in accordance with a first aspect of the present invention.

FIG. 3 schematically shows a detail of the fixing member 15. The lower surface of the fixing member is shown. A plurality of molded hooks 31 which are integral with the fixing member 15 are provided on its lower surface 21. The fixing member 15 is a diamond shape with acute corners 33 and 35. The clip 17 (FIG. 2) for fixing the member to the base plate is designed such that the member 15 can be fixed with either corner 33, 35 at the point of toe 29.

The hooks are not present at corners 33 and 35. This is because the hooks at these corners will experience a lot of heat and as a result, they might melt. The melted hooks will seep out of the sides of the base plate 1 degrading the performance of the sander.

Figure 5:
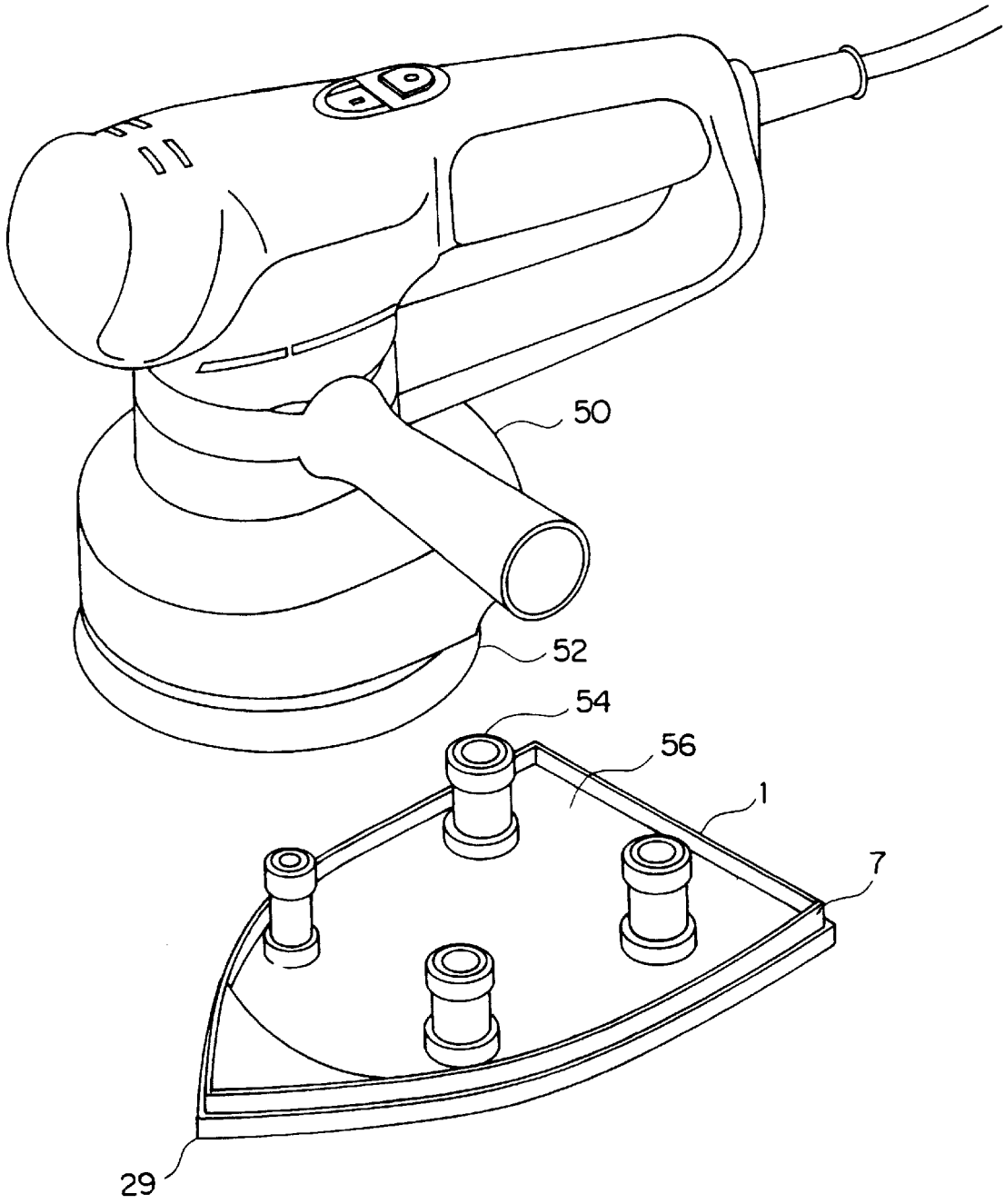
FIG. 5 shows a sander with the base plate of FIG. 4.

FIG. 5 shows the base plate removed from a sander 50. The sander 50 is a hand held sander and is electrically powered. The sander 50 has a lower fitment plate 52 which the sander base plate 1 can be attached to.

The sander base plate 1 is attached via lower fitment plate 52 and plugs 54 to the sander 50. The plugs 54 are located on an upper surface 56 of the base plate. The upper surface 56 forms part of the rigid upper layer 7 of the base plate 1.

Figure 6:
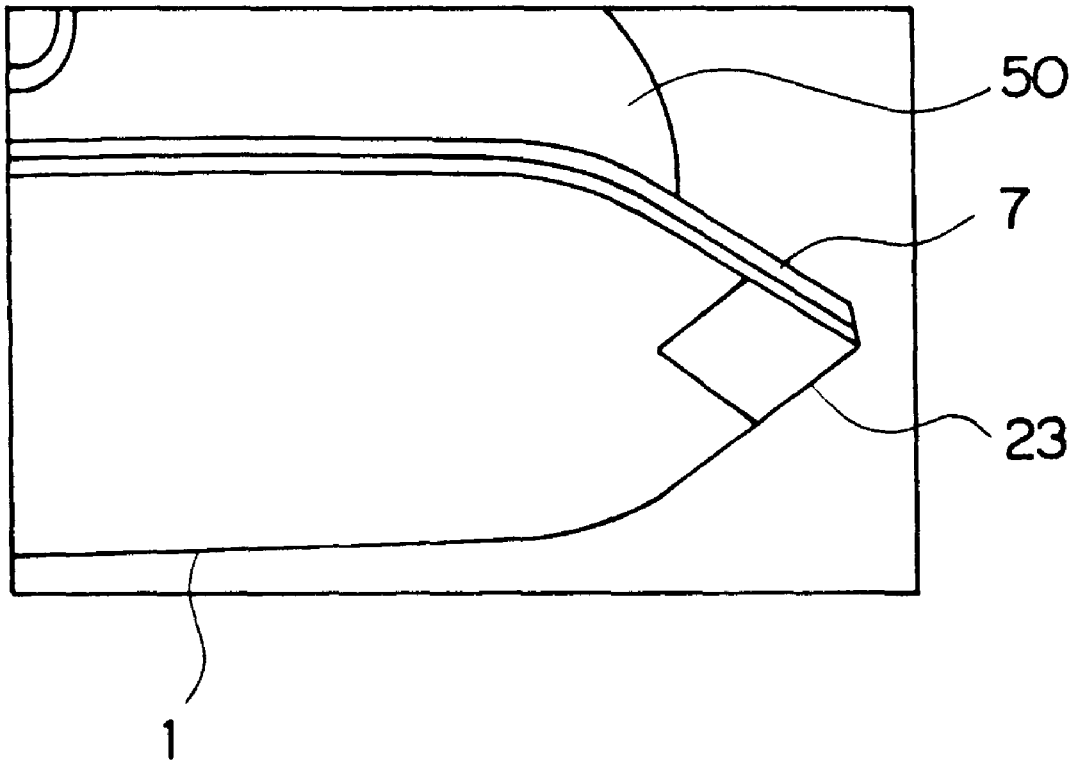
FIG. 6 shows a view of the underneath of the sander and base plate of FIG. 5.

FIG. 6 shows part of the underneath of the base plate 1 when it is attached to the sander 50. The removable front section 23 is located at the pointed toe 29 of the base plate 1.

Figure 7:
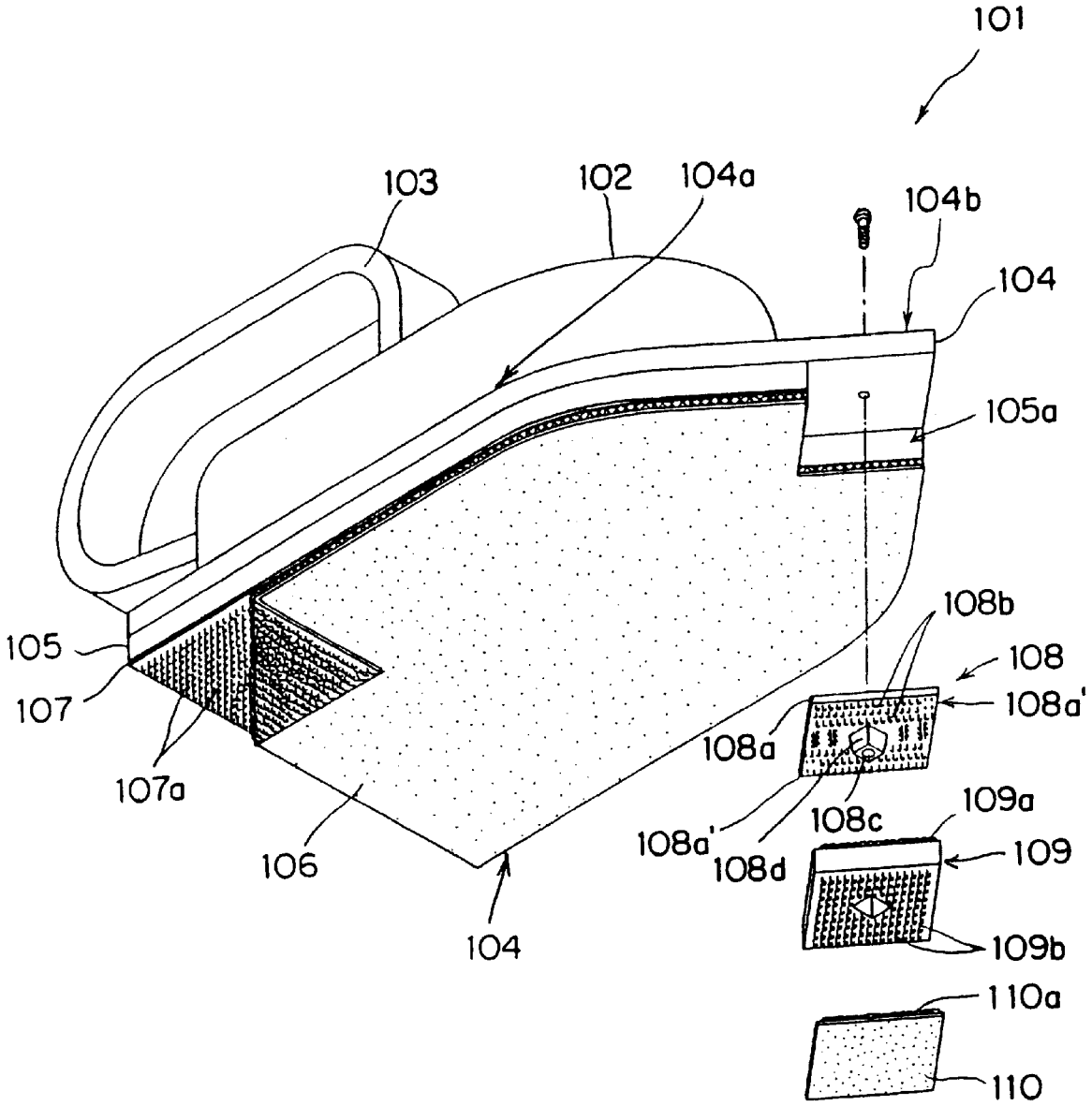
FIG. 7 is an entire perspective view of the underneath of a sander according to another embodiment of the invention.

FIG. 7 schematically shows a construction of a portable sander according to another embodiment of the invention. In FIG. 7, a numeral 101 designates a portable sander. The portable sander 101 of the illustrated example has a handle 103 on its body 102, and is completely manually operated having no vibration generator inside the body 102.

A flat metal base plate 104 is firmly attached on a lower surface of the body 102. The base plate 104 may be made of synthetic resin. The base plate 104 has a shape that an acute corner 104*b* of isosceles triangle extends from an end of a rectangular portion 104*a* as shown in FIG. 7. A sand cloth 106 is removably attached on the lower surface of the base plate 104 via a compressible intermediate member 105 except a distal end of the base plate 104. The sand cloth 106 has a shape same as that of the member 105. The compressible intermediate member 105 is made of heat-resistant synthetic rubber or heat-resistant synthetic resin foam. A male engaging member 107 of a surface fastener made of woven or knitted sheet or synthetic resin sheet and having a plurality of hooks 107*a* is integrally attached to the lower surface of the member 105 by adhesive. On the other hand, on a rear surface of the sand cloth 106, a female engaging member of the surface fastener to be engaged with the male engaging member 107 is integrally attached by adhesive.

A cutout 105*a* of the compressible intermediate member 105, which corresponds to the distal end of the base plate 104, is in a form of diamond composed of two longitudinally arranged isosceles triangles each having the same shape as the acute corner 104*b* with their bottom lines put together. A fixing member 108 of the invention is applied to the cutout 105*a*. Of course, the shape of the cutout 105*a* should not be limited to the diamond.

The fixing structure of the sand paper or cloth according to this embodiment is composed of a fixing member 108 fitted in the cutout 105*a* of the compressible intermediate member 105, having the same diamond shape as the cutout 105 as shown in FIG. 7 and being removably attached to the base plate 104, a compressible intermediate piece 109 of the same material and shape as the compressible intermediate member 105 which is to be removably attached to the fixing member 108, and a sand cloth 110 having a diamond shape and removably attached on a lower surface of the compressible intermediate piece 109.

The fixing member 108 is a molded product made of thermoplastic synthetic resin having high rigidity. On one surface of a sheet-like substrate member 108*a* having the same shape as the cutout 105*a*, a plurality of hooks 108*b* are integrally molded except at an acute corner 108*a*'. In this embodiment, a screw hole 108*c* is provided in the center of the substrate member 108 for fixing the fixing member 108 onto the lower surface of the metal base plate 104 by means of a screw. The screw hole 108*c* is formed along an axis of a pillar projection 108*d* which projects from the center of the substrate member 108*a* and fits in a fitting hole 109*b* formed in the compressible intermediate piece 109. The pillar projection 108*d* has a function to reinforce the screw hole 108*c*.

The hooks 108*b* of this embodiment are arranged in rows on both sides of the pillar projection 108*d*. According to the arrangement as illustrated, four groups of hooks, each group being composed of two rows, each row being composed of five hooks 108*b*, are disposed on both sides of the pillar projection 108*d*, two groups being provided on one side thereof. And two groups of hooks, each group being composed of four rows, each row being composed of nineteen hooks 108*b*, are disposed perpendicular to the direction of hook rows of the former hook groups, on both sides of the former hook groups and the pillar projection 108*d*. Further, two groups of hooks, each group being composed of three rows, each row being composed of fifteen hooks 108*b*, are disposed parallel to and on both outer sides of the previously described two hook groups toward acute corners 108*a*". With such arrangement of hooks 108*b*, there should be no directivity in engagement with mating loops so that the engaging strength and engaging rate improve.

Figure 8:
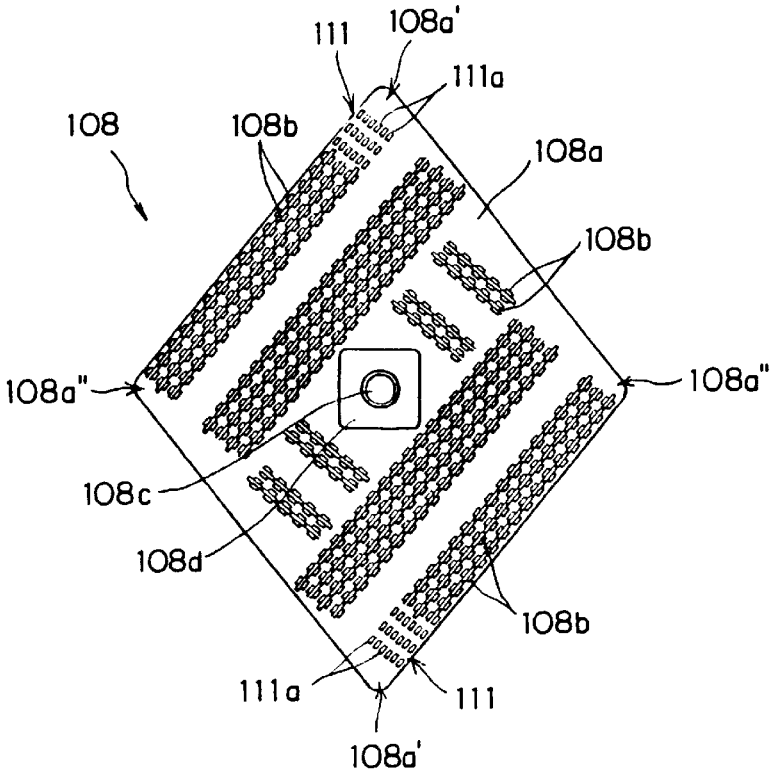
FIG. 8 is a bottom plan view of a fixing member according to the embodiment of FIG. 7.
Figure 9:
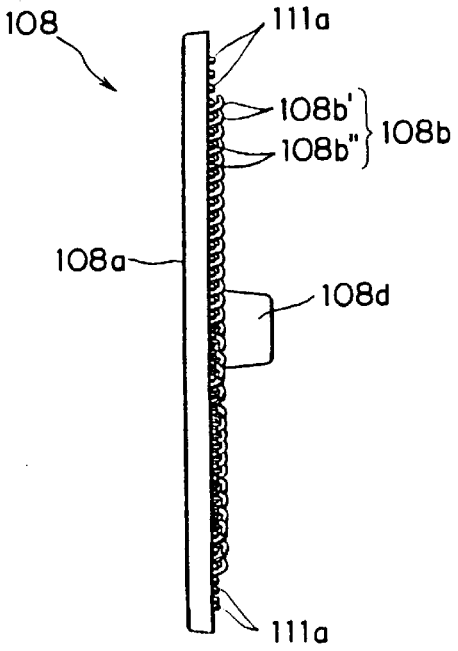
FIG. 9 is a side of the fixing member of FIG. 8.

Projecting portions 111 are provided at the acute corners 108*a*' of the substrate member 108*a* which is the characteristic feature of the invention, as shown in FIGS. 8 and 9 in enlarged scale. The projecting portion 111 is composed of a plurality of projections 111*a*. In the illustrated example, one acute corner 108*a*' has six by three, i.e. eighteen projections 111*a*. The projections 111*a* of this embodiment can be molded on the surface of the substrate member 108*a* by effectively using a plurality of non-illustrated molding plates which compose a mold of the fixing member 108. Generally, in this type of mold for integrally molding hooks, it is impossible to provide hook-forming cavities directly in one member because of the curving shape of the hooks. Therefore, a plurality of molding plates are formed to have desired cutouts to totally compose the whole shape of the hooks by electric discharge processing, and they are put in laminate to have the hook-forming cavities.

Figure 10:
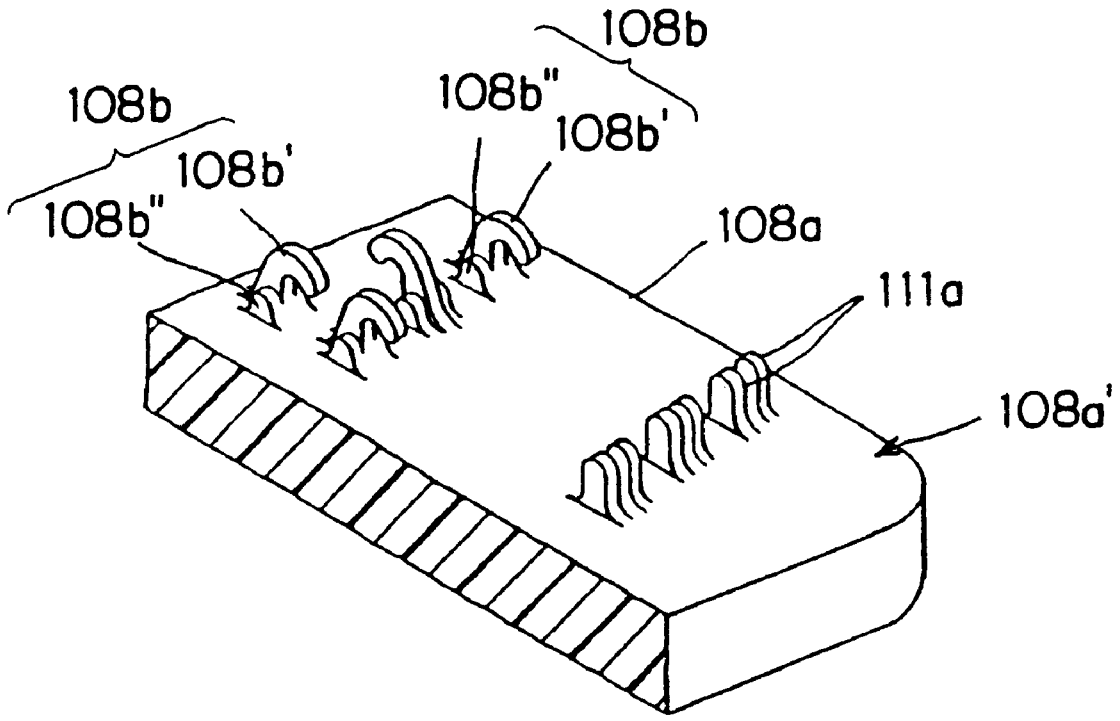
FIG. 10 is a fragmentary perspective view showing a structural example of a lower surface of an acute corner of a toe of the fixing member, in enlarged scale.

As shown in FIG. 10 in enlarged scale, the hook 108*b* has reinforcing ribs 108*b*" integrally molded on both sides of the hook body 108*b*'. The reinforcing ribs 108*b*" and the hook body 108*b*' are molded respectively in the separate cavities in laminate. In the illustrated example, the projections 111*a* are molded using the cavities for the reinforcing ribs 108*b*". Namely, the hook bodies between the reinforcing ribs 108*b*" are not molded. Thus only the reinforcing ribs 108*b*" are molded to be used as the projections 111*a*. Therefore, the height of the projections 111*a* is shorter than the height of the hooks 108*b*.

The fixing member 108 may be attached to the metal base plate 104 by means of clip engagement instead of screw. Specifically, a projecting engaging head axially divided in two parts may be formed centrally on a side opposite to the surface of the substrate member 108*a* on which the hooks 108*b* are formed, and the head may be inserted in an engaging hole provided in the base plate 104 to fix the substrate member 108*a* to the base plate 104.

Figure 11:
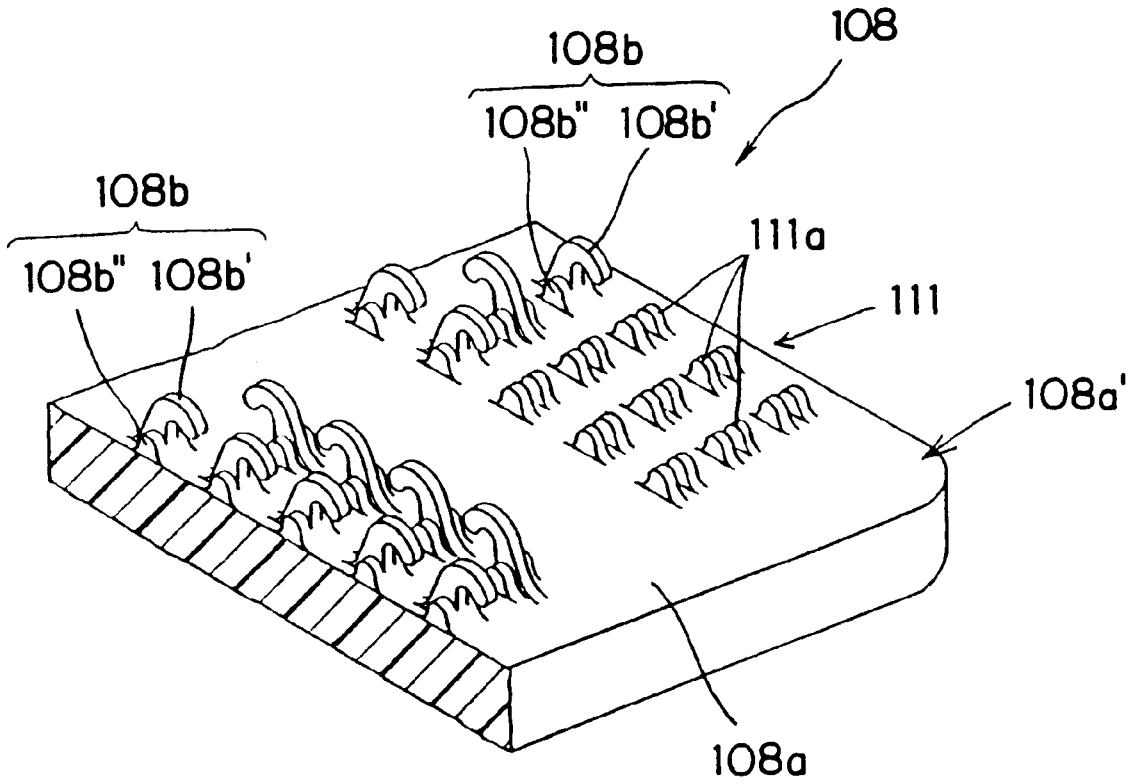
FIG. 11 is a fragmentary perspective view showing a modification of the structure of the lower surface of the acute corner of FIG. 10, in enlarged scale.
Figure 12:
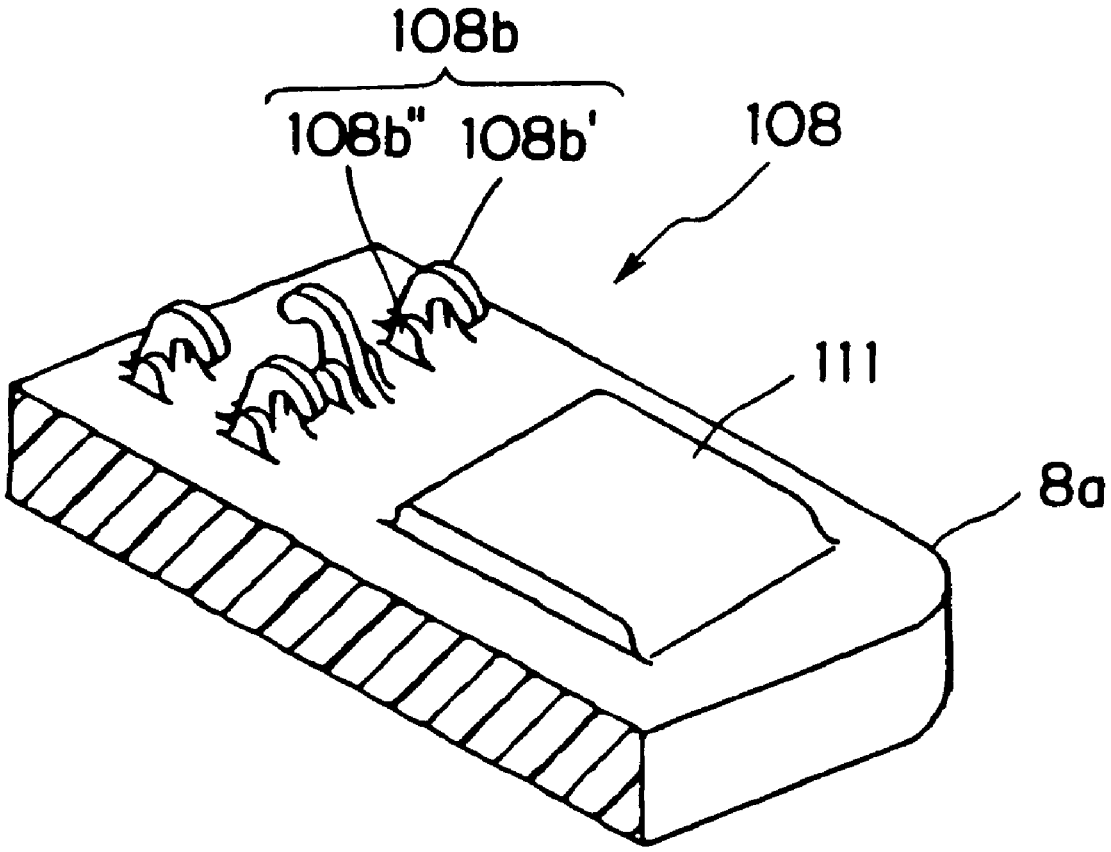
FIG. 12 is a fragmentary perspective view showing another modification of the structure of the lower surface of the acute corner of FIG. 10, in enlarged scale.
Figure 13:
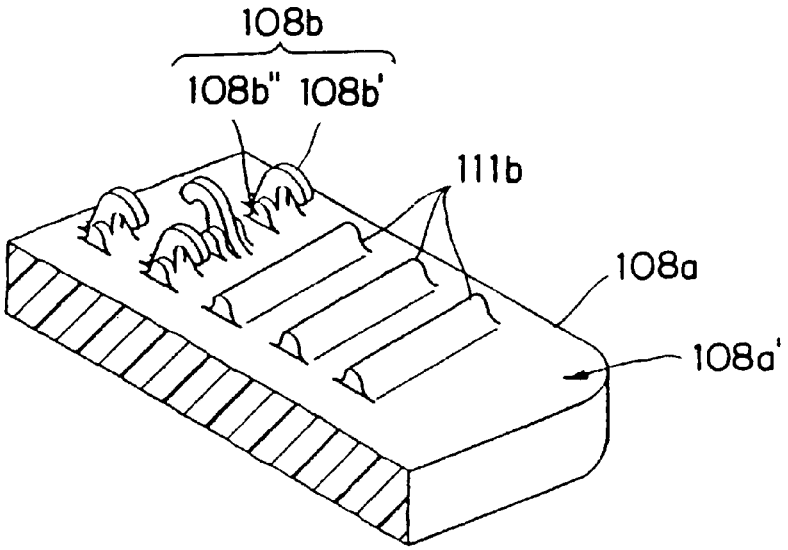
FIG. 13 is a fragmentary perspective view showing still another modification of the structure of the lower surface of the acute corner of FIG. 10, in enlarged scale.
Figure 14:
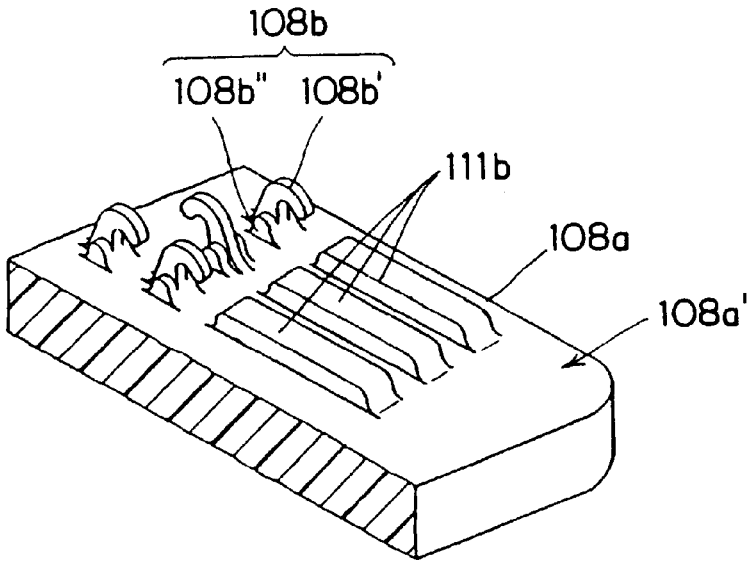
FIG. 14 is a fragmentary perspective view showing still another modification of the structure of the lower surface of the acute corner of FIG. 10, in enlarged scale.

The number of the projections 111*a* should not be limited to this embodiment. Alternatively, as shown in FIG. 11 for example, only six projections 111*a* may be provided in an outermost edge portion of the acute corner 108*a*' and others may be omitted. Also, the projecting portion should not be limited to be a group of projections 111*a*. Alternatively, as shown in FIGS. 12 to 14, a flat projecting portion 111 may be formed, or a plurality of ridges 111*b* having a length equal to width or length of three hooks, perpendicularly to or in extension of the hook rows.

The compressible intermediate piece 109 is made of the same material as the compressible intermediate member 105 and has the same shape as the fixing member 108. The piece 109 has on one surface a plurality of loops 109*a* to be engaged with the hooks 108*b* of the fixing member 108. In this embodiment, the loops 109*a* are piles of pile fabric, and the pile fabric is adhered firmly by adhesive etc. onto one surface of the compressible intermediate piece 109 with the piles facing outwardly. On the other surface of the compressible intermediate piece 109, a plurality of hooks 109*b* are formed. These hooks 109*b* are formed by weaving monofilaments in a fabric substrate to have loop-shape, and by cutting a part of each pile. Of course, the hooks 109*b* can be molded integrally and simultaneously with the compressing intermediate piece 109, like the fixing member 108. However, hooks made by weaving are commonly used in view of strength. A fitting hole 109*c* is formed in the center of the compressible intermediate piece 109 for the pillar projection 108*d* of the fixing member 108 to fit in.

A plurality of loops 110*a* are formed on a rear surface of the sand cloth 110 for engaging with the hooks 109*b* of the compressible intermediate piece 109. The loops 110*a* are obtained using piles of a pile fabric, like the loops 109*a* of the compressible intermediate piece 109. Therefore, in this embodiment, the pile fabric is adhered onto a surface of the sand cloth 110 with the piles facing outwardly.

With the fixing structure as described above, as shown in FIG. 7 for example, the fixing member 108 is fixedly attached by means of the screw etc. to the acute corner 104*b* at the distal end of the base plate 104 which is firmly attached onto the lower surface of the body 102 of the portable sander. The loops 109*a* of the compressible intermediate piece 109 are pressed against the lower surface of the fixing member 108 where the hooks 108*b* are formed, so that the compressible intermediate piece 109 is engaged to be fixed to the fixing member 108. The loops 110*a* of the sand cloth 110 are pressed against the lower surface of the compressible intermediate piece 109 on which the hooks 109*b* are formed, so that they are firmly engaged with each other.

Sanding process can be done in usual manner using the portable sander 101 of the embodiment to which the sand cloth 110 is attached. Conventionally, the distal end, especially the acute corner of the base plate gets very hot so that the distal end of the fixing member attached to the base plate is influenced by the heat. To the contrary, in the portable sander 101 of this embodiment, there provided a gap between the base plate 104 and the acute corner 108*a*' at the distal end of the fixing member 108 via the projecting portions 111. Consequently, both the base plate 104 and the acute corner 108*a*' can hardly get hot and the hooks 108*b* around there do not melt to improve durability.

Moreover, the acute corner of the compressible intermediate piece 109 does not contact with the acute corner 108*a*' of the fixing member 108 due to the presence of the projecting portions 111, thus preventing a step to be formed at the acute corner. Therefore, smooth and uniform sanding operation can be done and the sanded surface should be neat as desired.

It should be understood that the typical embodiments of the invention are described above, and the invention should by no means be limited to the illustrated examples, and various modifications are possible within the scope of the invention.

What is claimed is:

1. A fixing member for joining a first section which forms part of a lower surface of a base plate of a sander to a second section of the base plate of the sander, the fixing member being rigid and substantially planar, a surface of the fixing member being provided with surface fastener means to attach the first section to said fixing member, the surface fastener means being integral with the fixing member.

2. A fixing member according to claim 1, wherein the fixing member is removably attached to the second section of the base plate.

3. A fixing member according to claim 1 or 2, wherein said fixing member is made of thermoplastic synthetic resin material and has the same shape as said part of said lower surface of said base plate, and wherein part of said fixing member which gets hot most is not provided with said surface fastener means.

4. A fixing member according to claim 3, wherein the surface fastener means comprise a plurality of molded hooks for engagement with a plurality of loops provided on the first section.

5. A fixing member according to claim 2, wherein a projecting portion which has a height shorter than said surface fastener means is provided at said part of said fixing member which does not have said surface fastener means.

6. A fixing member according to claim 1, wherein the fixing member joins the first section to the second section such that the first section forms at least a part of a pointed front toe of the base plate.

7. A fixing member according to claim 1, wherein the fixing member is capable of being attached to the second section in more than one orientation.

8. A fixing member according to claim 6 or 7, wherein the fixing member is a diamond shape and attachable to the second section of the base plate in one of two orientations, such that either of the two acute corners of the fixing member can be attached at the point of the front toe of the base plate.

9. A fixing member according to claim 8, wherein said point of the front toe of said two acute corners of the fixing member are parts which get hot most.

10. A fixing member according to one of claims 1 or 2, wherein the surface fastener means comprise a plurality of molded hooks for engagement with a plurality of loops provided on the first section.

11. A fixing member according to claim 1, wherein the fixing member is attached to the second section such that an upper surface of the fixing member is adjacent a surface of the second section; the upper surface of the fixing member being located on the opposing surface of the fixing member to the surface fastening means.

12. A fixing member according to claim 11, wherein the fixing member further comprises a screw threaded hole, such that said fixing member is attached to the second section via a screw.

13. A fixing member according to claim 11, wherein the fixing member comprises a clip for attaching the fixing member to the second section.

14. A fixing member according to claim 13, wherein the clip comprises at least two spaced apart elongate members which project away from of the plane of the fixing member on the opposing side of the member to the surface fastener means, the elongate members being provided with lugs to engage a complementary member of the second section.

15. A base plate for a sander, the base plate having a lower surface which comprises means for attaching sandpaper thereto, the base plate comprising a removable first section which forms part of the lower surface of the base plate, the first section being attached to a second section of the base plate by a rigid substantially planar fixing member, the fixing member comprising surface fastener means for attaching said first section to said fixing member and said surface fastener means are integral with said fixing member.

16. A base plate according to claim 15, wherein the second section of the base plate comprises a lower layer which forms a part of the lower surface of the base plate and an upper layer fixed to the lower layer, the upper layer extending beyond the lower layer in a direction parallel to the plane of the lower surface of the base plate to provide a surface for attachment of said fixing member thereto.

17. A base plate according to claim 16, wherein the fixing member has upper and lower surfaces which are separated by sidewalls, wherein at least a part of a sidewall of the fixing member forms a part of a sidewall of the base plate.

18. A base plate according to any of claims 15 to 17, wherein the first section forms part of a pointed front toe of the base plate.

19. A base plate according to claim 18, wherein the fixing member is removable.

20. A base plate according to claim 19, wherein the fixing member is fixed to said second section by a screw.

21. A base plate according to claim 19, wherein the fixing member is attached to the second section by a clip.

22. A base plate according to claim 17, wherein the fixing member has two sidewalls which meet at a point which form at least a part of the sides of the pointed front toe of the base plate.

23. A base plate according to any of claims 15, 17 or 22, wherein the fixing member is removable.

24. A base plate according to claim 23, wherein the fixing member is fixed to said second section by a screw.

25. A base plate according to claim 23 wherein the fixing member is attached to the second section by a clip.

26. A base plate according to claim 15, wherein the fixing member is integral with the second section of the base plate.

27. A base plate according to claim 15, wherein the surface fastener means of the fixing member do not extend as far as the point of the front toe of the base plate.

28. A base plate for a sander, the base plate comprising a removable front section which forms a part of a lower surface of the base plate, wherein the removable front section is attached to the remainder of the base plate via surface fastener means, the surface fastener means being provided to fasten an upper surface of the removable front section to a surface on the remainder of the base plate, the surface fastener on the remainder of the base plate being integral with the base plate.

29. A base plate for a sander according to claim 28, wherein the base plate further comprises a detachable fixing member and the surface fastener means provided on the remainder of the base plate are integral with the fixing member.

30. A fixing member for a sander base plate having first and second lower surface sections, the fixing member comprising:

a rigid layer having a surface; and a surface fastener on the surface and integral with the fixing member, the fixing member attachable to the first lower surface section of the sander base plate by the surface fastener.

* * * * *